United States Patent [19]

Marchadour

[11] Patent Number: 4,602,964

[45] Date of Patent: Jul. 29, 1986

[54] VALVE REMOVAL AND CLEANING SYSTEM FOR CONTAINER FILLING APPARATUS

[76] Inventor: Jean-Charles Marchadour, 29 120 Pont l'abbe la Feuilleraie" Kerbascol, St. Jean Trolimon, France

[21] Appl. No.: 704,345

[22] Filed: Feb. 22, 1985

Related U.S. Application Data

[63] Continuation-in-part of Ser. No. 549,788, Nov. 8, 1983, Pat. No. 4,501,622.

[51] Int. Cl.[4] ..... B08B 3/02

[52] U.S. Cl. ..... 134/18; 134/22.18; 134/23; 134/33; 141/90; 141/91

[58] Field of Search ..... 134/18, 22.18, 23, 33, 134/56 R, 57 R, 58 R, 59, 140, 146, 151, 152, 165, 170, 171; 141/89, 90, 91, 146; 137/15, 237

[56] References Cited

U.S. PATENT DOCUMENTS

| | | | |
|---|---|---|---|
| 1,254,190 | 1/1918 | Baker | 141/146 X |
| 2,961,013 | 11/1960 | Johnson | 141/146 X |
| 2,998,037 | 8/1961 | Bingham | 141/146 X |
| 3,568,734 | 3/1971 | Vadas et al. | 141/89 |

*Primary Examiner*—George Yeung
*Attorney, Agent, or Firm*—Thorpe, North & Western

[57] ABSTRACT

A valve removal and cleaning system for flowable material filling devices includes a hopper for holding the material, a plurality of spaced-apart filling assemblies, each of which includes a cylinder mounted on the hopper and into which the material flows from the hopper, and a piston movable in the cylinder to force the material from the cylinder into containers. A plurality of valve housings interconnect the hopper with the cylinders, with each valve housing having an opening at the bottom thereof for receiving a valve element. A plurality of valve elements are provided for disposition in a respective valve housing, with the valve elements being mounted on a valve holder which in the form of a plate or a bracket located below the hopper. A frame support is positioned below the valve holder, and a locking mechanism operates to selectively lock the valve holder plate either to the frame support or to the hopper. The system is operated to lower the hopper and valve holder plate downwardly until the valve holder plate contacts the frame support, and the locking mechanism locks the valve holder plate to the frame support. The hopper is then raised to cause removal of the valve elements from the valve housings where spraying apparatus is then automatically operated to clean the valve housings and elements. The hopper is then automatically lowered so that the valve elements are reinserted into their housings, and then the valve holder plate is unlocked from the frame support and locked to the hopper to prepare for use in the container filling process.

12 Claims, 5 Drawing Figures

VALVE REMOVAL AND CLEANING SYSTEM FOR CONTAINER FILLING APPARATUS

BACKGROUND OF THE INVENTION

This is a continuation-in-part application of application, Ser. No. 549,788, filed Nov. 8, 1983, now U.S. Pat. No. 4,501,622.

This invention relates to apparatus and method for automatically removing and cleaning the valves of devices which are used for filling containers with flowable food material such as liquid, semi-liquid or pasty products.

Apparatus and processes for automatically filling containers such as cans with both food and non-food products have become very sophisticated. Such apparatus and processes are used to fill containers with liquid, semi-liquid, pasty or solid products including both food products such as liver paste, baby foods, jellies, vegetable oil, mustard, sauces, etc., and non-foods such as mineral oil, wax, paints, etc. It is important, especially when filling containers with food products, that the apparatus used be appropriately cleaned and sanitized. Cleaning and sanitation is typically required after use of the apparatus for some predetermined period of time to can one product, or after completion of canning of one product and before beginning the canning of a different product.

The manner in which flowable material filling devices are cleaned and sanitized would depend in part on the structure of the devices. Such devices may take a variety of forms, one of the most popular of which is the so-called rotary piston filler such as the MR 16, MR 22 and MR 30 units manufactured by Hema International, Inc. of Utah. Rotary fillers typically include a generally cylindrical hopper made, for example, of stainless steel, a number of filling assemblies spaced apart about the exterior of the hopper, and a container or can conveying system for moving cans into position underneath the filling assemblies to receive product. The filling assemblies each typically include a vertically disposed cylinder, a valve mechanism coupling the lower end of the cylinder to the hopper and operable to either allow material to flow from the hopper into the cylinder or to flow from the cylinder into a can positioned below the valve mechanism, and a piston movable in the cylinder to force material from the cylinder into the can. Rotary fillers also typically include a piston support structure for causing the pistons to move upwardly in the cylinders when product is flowing from the hopper into the cylinders, and downwardly when product is being forced from the cylinders into cans.

Cleaning of rotary fillers in the past has involved the manual removal of both pistons from their cylinders and valves or valve elements from their housings, and then the spraying of the cylinders, pistons, valves and valve housings with some type of sanitizing liquid. After cleaning of the parts, the pistons would then be manually replaced in the cylinders and the valves manually replaced in the valve housings. Such cleaning process is both time consuming and inconsistent in that since everything is done manually, attendants must be present to perform the cleaning and the thoroughness of the cleaning may vary from one time to the next. Also, because of the requirement of handling the valves and pistons, the possibility of dropping and damaging such elements, through carelessness of attendants, is always present.

SUMMARY OF THE INVENTION

It is an object of the invention to provide apparatus and method for automatically removing valve elements from valve housings of a flowable material filling device, and for automatically cleaning such elements and housings.

It is another object of the invention to provide such apparatus and method for efficiently, rapidly and thoroughly cleaning filling assemblies of a flowable material filling device.

It is a further object of the invention to provide such apparatus and method for eliminating the need for hands-on intervention in the cleaning of filling assemblies of flowable material filling devices.

The above and other objects of the invention are realized in a specific illustrative embodiment thereof which may be utilized for cleaning a flowable material filling device composed of a hopper for holding the material, a plurality of spaced-apart filling assemblies, each of which includes a cylinder mounted on the hopper and into which material flows from the hopper, and a piston movable in the cylinder to force material from the cylinder into containers. Valve removal apparatus includes a plurality of valve housings, each positioned to interconnect the hopper with a corresponding cylinder, and each including an opening at the bottom thereof for receiving a valve element. A plurality of valve elements are provided, each for disposition in a different valve housing. A valve holder, in the form of a plate or bracket, is positioned below the hopper, and the valve elements are mounted on the holder. A frame support is positioned below the valve holder. The valve removal apparatus also includes a locking mechanism which operates to selectively lock the valve holder either to the frame support or to the hopper and valve housings. Apparatus for raising the hopper and valve housings is provided so that when the valve holder is locked to the frame support, the hopper and valve housings may be raised to cause removal of the valve elements from the housings. Valve controlled liquid spray nozzles are positioned to spray liquid into the valve housings and onto the valve elements when the elements are removed from the housings. After cleaning the valve elements and housings, the hopper and housings may be lowered back towards the valve holder to cause reinsertion of the valve elements into the housings. The holder may then be unlocked from the frame support and locked to the hopper and valve housings, and the hopper, valve housings and valve holder raised upwardly to a position for filling containers.

Advantageously, a control unit is provided for automatically controlling the raising and lowering of the hopper and valve housings, the locking of the valve holder either to the frame support or to the hopper, and the turning on and off of the liquid spray apparatus.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
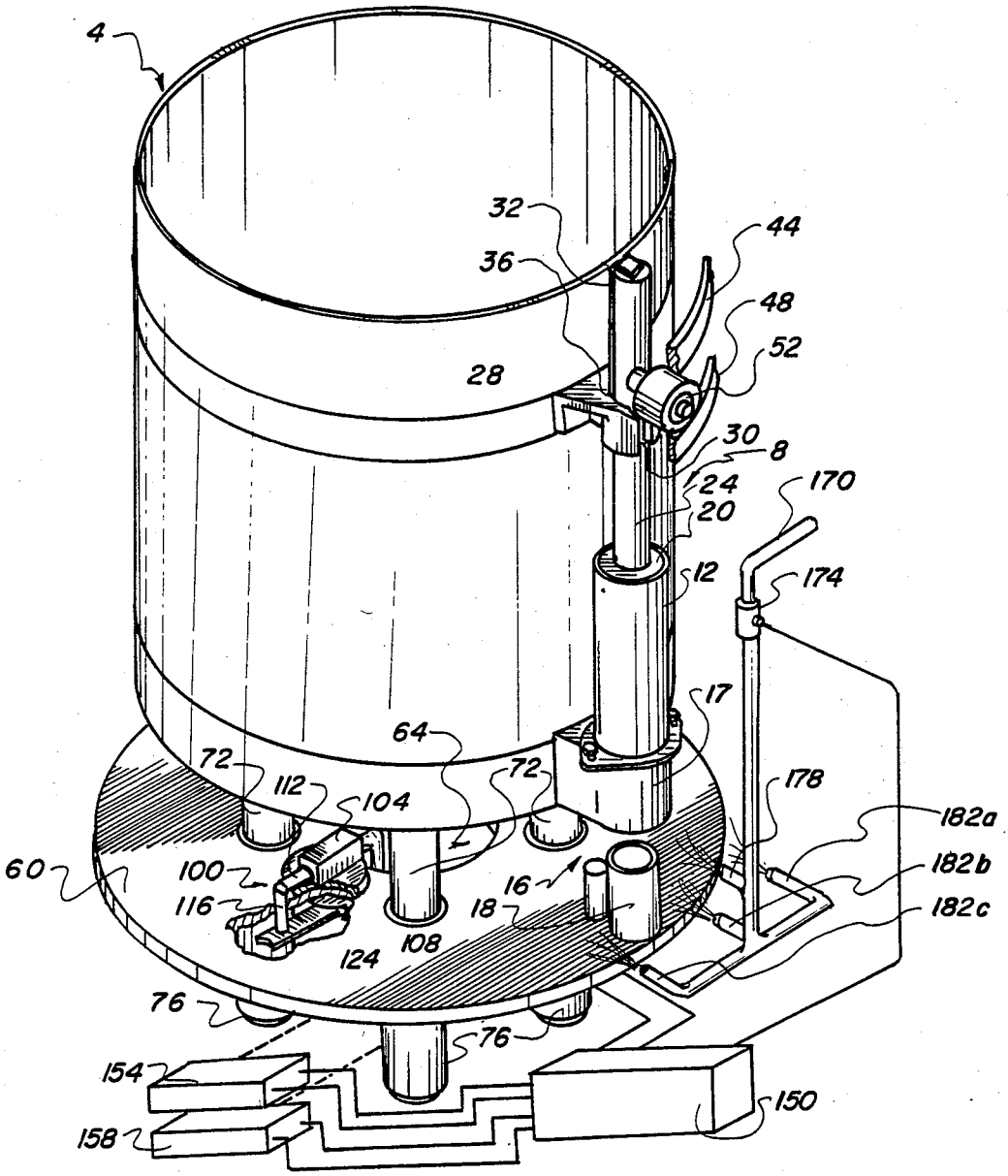
FIG. 1 shows a perspective, fragmented view of a valve removal and cleaning system for container filling apparatus made in accordance with the principles of the present invention.
Figure 3:
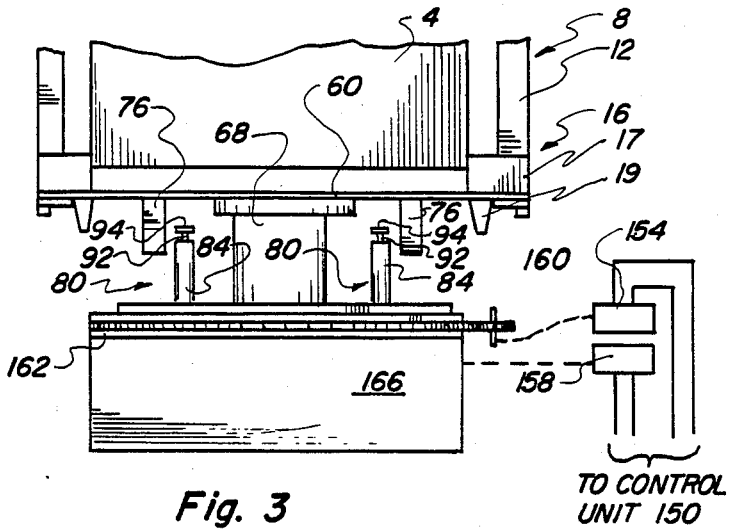
FIG. 3 shows a side, elevational, and fragmented view of the system of FIG. 1.

Referring to the drawings, and in particular to FIGS. 1 and 3, there is shown apparatus for automatically removing valves from valve housings and for cleaning the valves and valve housings of a rotary filler of the type manufactured by Hema International, Inc. The rotary filler includes a generally cylindrical hopper 4 mounted to rotate about its cylindrical axis. The hopper is for holding flowable material such as baby foods, vegetable oil, wax, paints, etc., which are to be dispensed into containers.

Mounted on the exterior of the hopper 4 are a plurality of spaced-apart filling assemblies 8, only one of which is shown in FIG. 1, and two of which are partially shown in FIG. 3. Each filling assembly includes a so-called dosing cylinder 12 mounted onto a filling valve mechanism 16 so that the axis of the cylinder 12 is oriented to be generally vertical. The valve mechanism 16 includes a valve housing or body 17 mounted on the side of the hopper 4 to communicate with the interior thereof. The valve housing 17 has an opening in the bottom thereof to receive a valve or valve element 18. When the valve element 18 is inserted in the valve housing 17, it may be operated to allow material contained in the hopper 4 to flow via the valve mechanism 16 into the cylinder 12, or to allow material in the cylinder 12 to flow downwardly through the valve mechanism and out a spout 19 into a container or can disposed below the valve, all in a well known manner. The filling assembly 8 also includes a piston 20 mounted on the lower end of a piston rod 24 which, in turn, is slidably mounted in a piston guide sleeve 28. The piston guide sleeve 28 is mounted on the side of the hopper 4 to hold the piston rod 24 in a generally vertical orientation so that the axis of the rod is colinear with the axis of the cylinder 12. The piston rod 24 includes an elongate key 32 which fits into an elongate groove 36 formed in the sleeve 28 to prevent the piston rod from rotating in the sleeve. The piston guide sleeve 28 allows the piston rod 24 to move upwardly or downwardly to enable removal of the piston 20 from the cylinder 12 and reinsertion of the piston into the cylinder. FIG. 1 shows the piston 20 in place within the cylinder 12. The conveyor system for positioning the containers or cans under the filling assemblies is not shown since it forms no part of the present invention.

The pistons 20 are caused to move in the cylinders 12 to alternately allow material to flow into the cylinders from the hopper 4 and then from the cylinders into cans located under the valve mechanisms 16. The movement of the pistons 20 takes place automatically as the hopper and filling assemblies are rotated. The structure for controlling this movement of the pistons includes a pair of tracks 44 and 48 (shown in fragmented form in FIG. 1) which form ramps encircling the hopper 4. The tracks 44 and 48 are spaced apart a fixed distance to receive therebetween rollers such as roller 52 which is mounted to rotate on an axle 56 which extends outwardly from the piston rod 24. The tracks 44 and 48 slope as they encircle the hopper 4 so that as the hopper and filling assemblies 8 are rotated, rollers 52 roll within the tracks 44 and 48 to move upwardly or downwardly as determined by the tracks. As the rollers are caused to move upwardly or downwardly, they cause the corresponding piston rod 24 and piston 20 to move upwardly or downwardly in the corresponding cylinder 12. Thus, when the cylinder 12 is being filled, the corresponding roller 52 is moving upwardly within the tracks 44 and 48 to raise the piston 20, and when the cylinder 12 is being discharged of its contents, the roller 52 is moving downwardly within the tracks to cause the piston 20 to move downwardly and force the material from the cylinder. An elongate opening 30 in front of the piston guide sleeve 28 accommodates vertical movement of the axle 56. All of the above is conventional structure.

The apparatus of the present invention might also include lifting mechanisms (not shown) positioned to lift or lower the tracks 44 and 48 to thereby lift the pistons out of the cylinders for cleaning and then lower the pistons back into the cylinders. Such a lifting mechanism is described in the aforecited patent application, Ser. No. 549,788.

The valve elements 18 are mounted on a valve holder plate or bracket 60 positioned below the hopper 4 and filling assemblies 8. The valve holder plate 60 is generally circular, as shown in FIG. 1, with a central opening 64 which fits about a center post 68 (FIG. 3) on which the hopper is mounted. Four guide posts 72 are attached at their upper ends to the bottom of the hopper 4 and are slidably fitted into sleeves 76 which are attached to and extend downwardly from the valve holder plate 60 as shown in FIGS. 1 and 3. The purpose of the guide posts 72 and sleeves 76 is to control and guide the raising and lowering of the hopper as will be discussed momentarily.

Positioned below the hopper 4 and valve holder plate 60 are a plurality of frame supports 80 (FIG. 3). Each of these frame supports includes a post 84 which extends upwardly from a base plate 88. The upper end of each support post 84 includes a reduced portion 92 and an enlarged cap 94. Located in the valve holder plate 60 directly above the support post 84 is a recess 96 for receiving the corresponding cap 94 (see FIGS. 2A through 2C).

Figure 2A:
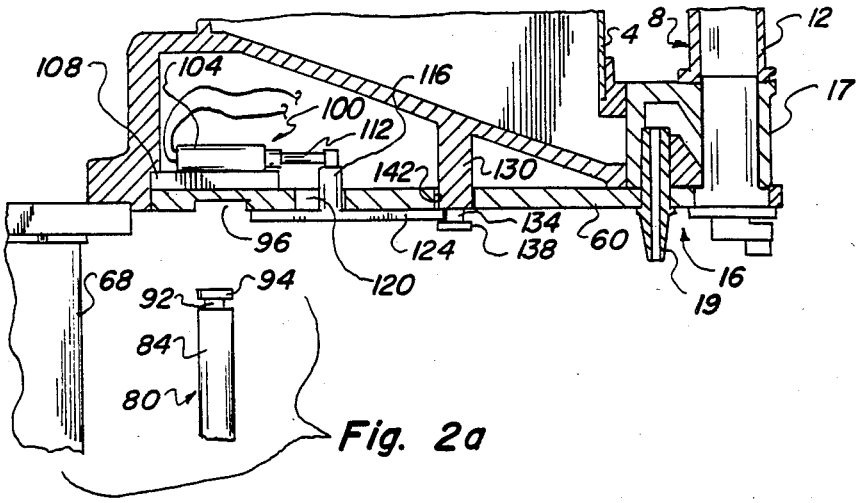
FIGS. 2A, 2B and 2C show a side, cross-sectional view of a portion of the hopper, filling assemblies, valve holding plate, and frame support of the system of FIG. 1 shown in various positions.
Figure 2B:
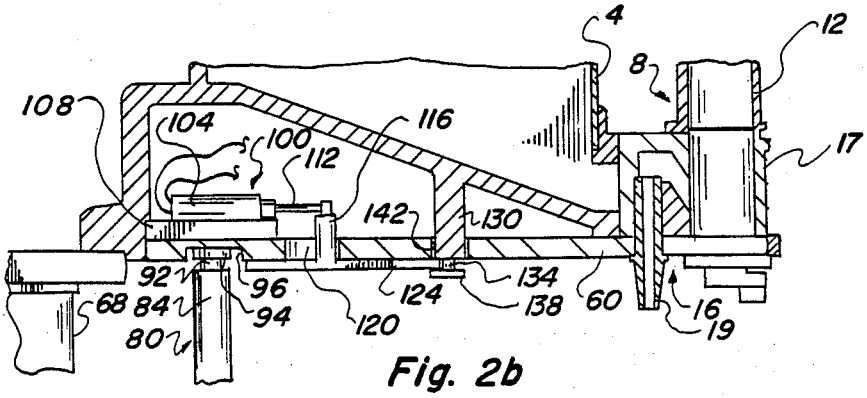
Figure 2C:
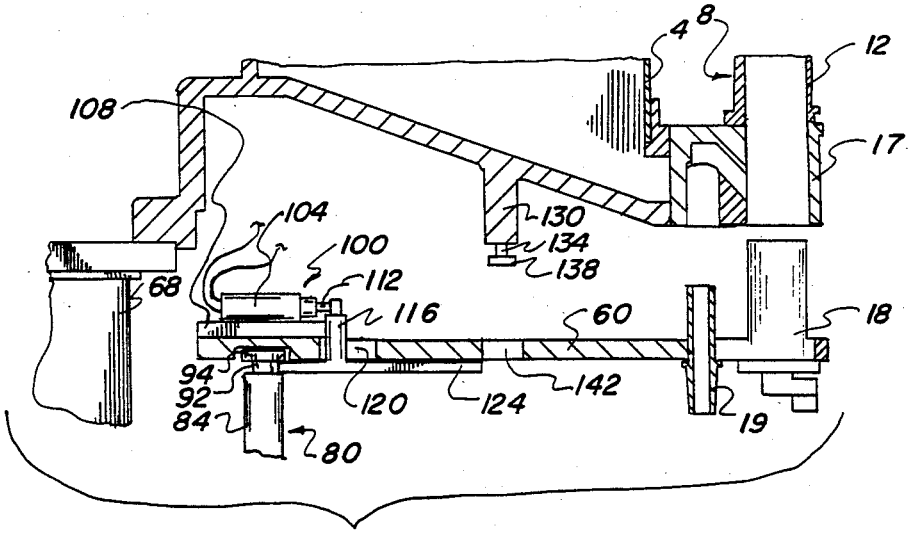

Mounted on the valve holder plate 60 are a plurality of locking mechanisms, only one of which 100 will be described for selectively locking the valve holder plate 60 either to the hopper 4 or the frame support 80 (see FIGS. 1 and 2A-2C). The locking mechanism 100 includes a solenoid 104 held in place by a base plate 108 which is attached to the valve holder plate 60. The solenoid 104 includes a movable element 112 which projects out one end of the solenoid and is coupled to the upper end of a vertically positioned finger 116. The lower end of the finger 116 extends through an opening 120 in the valve holder plate 60 and is attached to a locking bar 124. The locking bar 124 is held in place generally against the under surface of the valve holder plate 60 as shown in FIGS. 2A through 2C. As the solenoid 104 operates to move the movable element 112 into and out of the solenoid, the locking bar 124 is caused to slide between two locking positions to be discussed later.

Extending downwardly from the bottom of the hopper 4 is a support post 130, the lower end of which is formed with a reduced section 134 and an enlarged undercap 138. An opening 142 is located in the valve holder plate 60 at a location just below the support post 130 to enable the support post to fit through the opening as shown in FIG. 2A. The support posts 84 and 130 are positioned in line with the locking bar 124 on opposite sides thereof so that when the locking bar is slid outwardly away from the solenoid 100, an end of the bar is received into the reduced section 134 of the post 130, and when the locking bar 124 is slid towards the solenoid 100, the other end of the bar is received into the reduced section 92 of the post 84. The ends of the locking bar 124 are formed to fit snuggly in the recesses defined by the reduced sections 92 and 134.

Operation of the solenoid 104 is under control of a control unit 150 which produces various control signals for generally controlling operation of the valve removal and cleaning apparatus of the present invention. The control unit 150 might illustratively be a special purpose, hard wired machine, or a stored program microprocessor. The control unit 150 simply applies an electrical signal to the solenoid 104 to either cause the solenoid to extend the movable element 112 or to retract the movable element to thereby lock the valve holder plate 60 to the hopper 4 or to the frame support 80 respectively.

The control unit 150 also controls the raising and lowering of the hopper 4 and attached assemblies, and the rotation of the hopper. This is accomplished by supplying electrical signals to a rotation motor 154 and a lift motor 158 (FIGS. 1 and 3). The rotation motor 154 is mechanically coupled by gears 160 to a rotation plate 162 which is rotatably mounted on a base 166. The center post 68 on which the hopper is mounted, and the frame supports 80 are carried by the base plate 88 mounted on the rotation plate 162. The rotation motor 154 may be electrically, pnuematically or hydraulically operated in response to control signals from the control unit 150 to effectuate rotation of the hopper. The lift motor 158 is mechanically coupled to the center post 68 by a worm gear or other suitable gearing or lifting mechanism to either raise or lower the center post and thereby raise or lower the hopper 4. The lift motor 158 likewise could be electrically, pneumatically, or hydraulically operated, again under control of the control unit 150.

The cleaning liquid spraying apparatus of the embodiment of the drawings includes a conduit 170 (FIG. 1) for conveying cleaning liquid under pressure from a source (not shown). Installed in the conduit 170 is an electrically controlled valve 174. The conduit 170 extends downwardly along the side of the hopper 4 and includes a spray nozzle 178 positioned to spray liquid cleaner into the valve housings 17 from which valve elements 18 have been removed, and three spray nozzles 182*a*, 182*b* and 182*c* spaced apart horizontally from one another and below spray nozzle 178 to spray liquid cleaner against the valve elements 18. The flow of liquid cleaner to the nozzles 178 and 182 is controlled by the valve 174 in response to signals received from the control unit 150. That is, the control unit 150 signals the valve 174 to selectively and automatically open or close to thereby either allow liquid spray cleaner to flow to the nozzles or to terminate flow of the spray cleaner.

Referring now to FIGS. 2A through 2C, an exemplary sequence of operation for cleaning the valve elements and valve housings will be described. These FIGS. are cross-sectional, fragmented views of the lower portion of the hopper 4, filler assemblies 8, valve holder plate 60 and frame support 80. FIG. 2A shows the position of the valve holder plate 60 relative to the hopper 4 when the rotary filler is in a position to dispense flowable material into cans. The height of the hopper 4 and filler assemblies 8 is determined by the height of the center post 68 on which the hopper is mounted. The height is selected depending upon the size of the cans into which flowable material is to be dispensed. In this position, the locking mechanism 100 has locked the valve holder plate 60 to the hopper as shown in FIG. 2A. In particular, the movable element 112 of the solenoid 104 is extended as shown so that the end of the locking bar 124 is received into the recess defined by the reduced section 134 of the support post 130 of the hopper. This holds the valve holder plate 60 against the bottom of the hopper.

The cleaning operation would begin by the control unit 150 signalling the lift motor 158 to lower the hopper 4 and attached assemblies toward the frame supports 80. Upon lowering of the hopper, the valve holder plate 60 would come to rest on the support posts 84 with the caps 94 being received into the recesses 96 of the valve holder plate. The control unit 150 then actuates the solenoid 104 to retract the movable element 112 and slide the locking bar 124 out of engagement with the support post 130 and into engagement with the support post 84. In particular, the end of the locking bar 124 opposite that which engages the support post 130 is received into the recess defined by the reduced section 92 to thereby lock the valve holder plate 60 to the frame support 80. The control unit 150 then signals the lift motor 158 to raise the hopper and this results in the valve elements 18, including the spout 19, being removed from the valve housing 17 as shown in FIG. 2C. In this exposed position, the control unit 150 signals the valve 174 to allow cleaning fluid to flow to the spray nozzles 178, 182*a*, 182*b*, and 182*c* (FIG. 1) to spray the valve housing 17 and valve elements 18. While the spray cleaner is being sprayed by the nozzles, the control unit 150 signals the rotation motor 154 to cause the hopper and filling assemblies to rotate so that the valve mechanism rotates past the nozzles and are thus cleaned. After a suitable time, the control unit 150 signals the rotation motor 154 and valve 174 to respectively stop rotation of the hopper and stop the flow of cleaning fluid. The control unit would then signal the lift motor 158 to lower the hopper back down onto the valve holder plate 60, and would then signal the solenoid 104 to extend the movable element 112 so that the locking bar 124 disengages the support post 84 and reengages the support post 130. Finally, the control unit 150 would signal the lifting motor 158 to raise the hopper to whatever elevation were desired for the next filling operation.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A valve removal system of a flowable material filling device which comprises a hopper for holding the material, a plurality of spaced apart filling assemblies, each of which includes a cylinder mounted on the hopper into which material flows from the hopper, and a piston movable in the cylinder to force material from the cylinder into containers, said system comprising a plurality of valve housings, each positioned to interconnect the hopper with a corresponding cylinder, and including an opening at the bottom thereof for receiving a valve element, a plurality of valve elements, each for dispostion in a different valve housing, a valve holder positioned below the hopper and on which the valve elements are mounted, and means for selectively moving the hopper and valve housings relative to the valve holder to thereby selectively cause removal of the valve elements from and insertion of valve elements into the valve housings.

2. A valve removal system as in claim 1 wherein the hopper and valve housings are adapted to be selectively moved upwardly from and downwardly toward the valve holder to selectively expose the valve elements.

3. A valve removal system as in claim 2 further including a frame, and a locking means for selectively locking the valve holder to the frame at a certain vertical level to thereby prevent vertical movement of the valve holder.

4. A valve removal system as in claim 3 wherein said locking means includes means for normally connecting the valve holder to the hopper and valve housings, and for disconnecting the valve holder from the hopper and valve housing when the valve holder is locked to the frame.

5. A valve removal system as in claim 4 wherein said frame includes a first support extending upwardly toward the valve holder and having a recess for receiving a locking element, wherein the hopper includes a second support extending downwardly toward the valve holder and having a recess for receiving a locking element, and wherein said connecting means comprises a locking element, movably mounted on the valve holder to move between a first position where it is received in the recess of the first support to lock the valve holder to the frame, and a second position where it is received in the recess of the second support to lock the valve holder to the hopper and valve housing.

6. A valve removal system as in claim 5 further including means responsive to a first signal for moving the locking element to the first position, and responsive to a second signal for moving the locking element to the second position, and control means for automatically and selectively supplying the first and second signal to the moving means.

7. A valve removal system as in claim 6 further comprising liquid spray means disposed to spray liquid against the valve elements when the valve elements are removed from the valve housings in response to a third signal, and wherein said control means is adapted to selectively supply the third signal to the liquid spray means.

8. Apparatus for cleaning a flowable material dispensing device which comprises a hopper for holding the material, a plurality of spaced-apart filling assemblies, each of which includes a cylinder mounted on the hopper and into which material flows from the hopper, and a piston movable in the cylinder to force material from the cylinder into containers, said apparatus comprising a plurality of valve bodies, each mounted on the hopper between the hopper and a corresponding cylinder, and including an opening at the bottom thereof for receiving a valve, a plurality of valves, each for disposition in a different valve body for controlling the flow of material into and out of the cylinders, a bracket positioned below the hopper for carrying the valves, means for selectively moving the hopper and valve bodies upwardly away from the bracket to cause removal of the valves from the valve bodies, and for selectively moving the hopper and valve bodies downwardly toward the bracket to cause replacement of the valves in the valve bodies, and liquid spray means disposed to spray liquid against the valves which are removed from the valve bodies.

9. Apparatus as in claim 8 wherein said moving means comprises means responsive to a first signal for moving the hopper and valve bodies upwardly, and responsive to a second signal for moving the hopper and valve bodies downwardly, and wherein said liquid spray means comprises means responsive to a third signal for spraying liquid against the valves, said apparatus further comprising control means for automatically supplying the first and second signals to the moving means, and the third signal to the liquid spray means.

10. Apparatus as in claim 9 wherein said flowable material dispensing device is a rotary filler in which the filling assemblies are mounted about the side exterior of the hopper, and the hopper, assemblies and bracket are adapted to rotate in response to a fourth signal, wherein the liquid spray means is disposed in a fixed position so that the valves carried by the bracket rotate past the liquid spray means as the bracket is rotated, and wherein said control means automatically supplies the fourth signal to the rotary filler.

11. Apparatus as in claim 10 further including a frame support, and latch means responsive to a fifth signal for latching the bracket to the frame support and responsive to a sixth signal for unlatching the bracket from the frame support and latching the bracket to the hopper and valve bodies, and wherein said control means automatically supplies the fifth and sixth signals to the latch means.

12. A process for cleaning a flowable material filling device which has a hopper for holding material, a plurality of spaced-apart filling assemblies mounted about the side exterior of the hopper, each including a cylinder into which material flows from the hopper and a piston movable in the cylinder to force material from the cylinder into containers, and a plurality of valve mechanisms each interconnecting the hopper to a corresponding cylinder and each including a valve housing joined to the corresponding cylinder and having an opening at the bottom for receiving a valve, and a valve for disposition in the valve housing to selectively guide material from the hopper to the corresponding cylinder and from the cylinder into a container, said process including the steps of automatically lowering the hopper, filling assemblies and a valve holding plate on which the valves are mounted, until the plate engages a support frame, locking the valve holding plate to the support frame, automatically raising the hopper and filling assemblies to thereby cause removal of the valves from the valve housings, activating a spraying mechanism to spray cleaning liquid agaist the valves and valve housings, automatically lowering the hopper and filling assemblies onto the valve holding plate so that the valves are reinserted into the valve housings, and unlocking the valve holding plate from the support frame and locking the valve holding plate to the hopper and filling assemblies.

* * * * *